US006305836B1

(12) United States Patent
Jarchau

(10) Patent No.: US 6,305,836 B1
(45) Date of Patent: Oct. 23, 2001

(54) FORCE ABSORBING HOMOGENIZATION VALVE

(75) Inventor: Michael Jarchau, Lubeck (DE)

(73) Assignee: APV North America, Inc., Wilmington, MA (US)

( * ) Notice: Subject to any disclaimer, the term of this patent is extended or adjusted under 35 U.S.C. 154(b) by 0 days.

(21) Appl. No.: 09/351,043

(22) Filed: Jul. 9, 1999

(51) Int. Cl.[7] ..... B01F 5/06

(52) U.S. Cl. ..... 366/176.2; 138/43; 137/625.3; 251/63.6

(58) Field of Search ..... 366/176.1, 176.2, 366/340; 138/42, 43, 46; 137/625.3; 251/127, 63.5, 63.6

(56) References Cited

U.S. PATENT DOCUMENTS

| | | | | |
|---|---|---|---|---|
| 1,451,393 | | 4/1923 | Hormann | 138/46 |
| 2,504,678 | * | 4/1950 | Gardner | 366/176.2 |
| 3,601,157 | | 8/1971 | Milleville et al. | 137/630.14 |
| 3,631,891 | | 1/1972 | Brumm | 137/625.3 |
| 3,732,851 | * | 5/1973 | Self . | |
| 3,746,041 | | 7/1973 | Friedland | 137/599 |
| 3,894,716 | | 7/1975 | Barb | 251/127 |
| 3,920,044 | * | 11/1975 | Gruner | 137/625.3 |
| 4,004,613 | | 1/1977 | Purton et al. | 137/625.3 |
| 4,011,287 | | 3/1977 | Marley | 261/64 R |
| 4,125,129 | | 11/1978 | Baumann | 137/625.3 |
| 4,199,267 | * | 4/1980 | Hendrikz | 366/176.2 |
| 4,278,619 | * | 7/1981 | Tiefenthaler . | |
| 4,316,478 | * | 2/1982 | Gonwer | 137/625.3 |
| 4,348,116 | | 9/1982 | Bordas | 366/340 |
| 4,352,573 | | 10/1982 | Pandolfe | 366/176 |
| 4,383,769 | * | 5/1983 | Pandolfe | 366/337 |
| 4,429,714 | | 2/1984 | Hughes et al. | 137/625.3 |
| 4,505,865 | * | 3/1985 | Wullenkord . | |
| 4,531,548 | | 7/1985 | Gottling et al. | 137/627.5 |
| 4,585,357 | * | 4/1986 | Ogata | 366/176.2 |
| 4,667,699 | | 5/1987 | Löliger | 138/31 |
| 4,671,321 | * | 6/1987 | Paetzel et al. | 137/625.3 |
| 4,860,993 | | 8/1989 | Goode | 251/127 |
| 4,938,450 | | 7/1990 | Tripp et al. | 251/30.03 |
| 4,944,602 | | 7/1990 | Buschelberger | 366/337 |
| 4,952,067 | * | 8/1990 | Dallas | 366/337 |
| 5,018,703 | | 5/1991 | Goode | 251/127 |
| 5,113,908 | | 5/1992 | Steinke | 137/625.3 |
| 5,309,934 | | 5/1994 | Jaeger | 137/1 |
| 5,380,470 | * | 1/1995 | Jacobson . | |
| 5,672,821 | | 9/1997 | Suzuki | 73/202 |
| 5,692,684 | | 12/1997 | Zurmühlen | 239/563 |
| 5,749,650 | | 5/1998 | Kinney et al. | 366/176.2 |
| 5,765,814 | * | 6/1998 | Dvorak et al. | 251/127 |
| 5,782,557 | | 7/1998 | Young | 366/176.2 |
| 5,887,971 | | 3/1999 | Gandini et al. | 366/176.2 |
| 5,899,564 | * | 5/1999 | Kinney et al. | 366/176.2 |
| 5,964,446 | * | 10/1999 | Walton et al. | 251/127 |

FOREIGN PATENT DOCUMENTS

WO 00/15327 3/2000 (WO) .

OTHER PUBLICATIONS

Leslie W. Phipps; "Effects of main flow reversal in a simple homogenizing valve"; Journal of Dairy Research; pp 525–528; Mar. 1978.

* cited by examiner

*Primary Examiner*—Tony G. Soohoo
(74) *Attorney, Agent, or Firm*—Hamilton, Brook, Smith & Reynolds, P.C.

(57) ABSTRACT

A homogenization valve includes a housing and stacked valve members within the housing. The valve members have central holes therethrough defining a high pressure volume. Each valve member includes a valve seat defining, with a valve surface, gaps through which fluid is expressed radially from an inside high pressure volume to the outer low pressure volume. An actuator closes one end of the central volume and acts on the valve members to control the width of the gaps. A pressure barrier is positioned within the central volume to reduce the force from the central volume acting on the actuator.

59 Claims, 6 Drawing Sheets

FORCE ABSORBING HOMOGENIZATION VALVE

RELATED APPLICATIONS

The present application is related to U.S. application Ser. Nos. 09/350,503 entitled "HOMOGENIZATION VALVE WITH OUTSIDE HIGH PRESSURE VOLUME" by Michael Jarchau and Ser. No. 09/350,504 entitled "VALVE MEMBERS FOR A HOMOGENIZATION VALVE" by Michael Jarchau, Harald O. Korstvedt, and Blaine Potter, both applications being filed concurrently with the present application and incorporated herein in their entirety by this reference.

BACKGROUND OF THE INVENTION

Homogenization is the process of breaking down and blending components within a fluid. One familiar example is milk homogenization in which milk fat globules are broken-up and distributed into the bulk of the milk. Homogenization is also used to process other emulsions such as silicone oil and process dispersions such as pigments, antacids, and some paper coatings.

The most common device for performing homogenization is a homogenization valve. The emulsion or dispersion is introduced under high pressure into the valve, which functions as a flow restrictor to generate intense turbulence. The high pressure fluid is forced out through a usually narrow valve gap into a lower pressure environment.

Homogenization occurs in the region surrounding the valve gap. The fluid undergoes rapid acceleration coupled with extreme drops in pressure. Theories have suggested that both turbulence and cavitation in this region are the mechanisms that facilitate the homogenization.

Early homogenization valves had a single valve plate that was thrust against a valve seat by some, typically mechanical or hydraulic, actuating system. Milk, for example, was expressed through an annular aperture or valve slit between the valve and the valve seat.

While offering the advantage of a relatively simple construction, the early valves could not efficiently handle high milk flow rates. Homogenization occurs most efficiently with comparatively small valve gaps, which limits the milk flow rate for a given pressure. Thus, higher flow rates could only be achieved by increasing the diameter or size of a single homogenizing valve.

Newer homogenization valve designs have been more successful at accommodating high flow rates while maintaining optimal valve gaps. Some of the best examples of these designs are disclosed in U.S. Pat. Nos. 4,352,573 and 4,383,769 to William D. Pandolfe and assigned to the instant assignee, the teachings of these patents being incorporated herein in their entirety by this reference. Multiple annular valve members are stacked one on top of the other. The central holes of the stacked members define a common, high pressure, chamber. Annular grooves are formed on the top and/or bottom surfaces of each valve member, concentric with the central hole. The grooves are in fluid communication with each other via axially directed circular ports that extend through the members, and together the grooves and ports define a second, low pressure, chamber. In each valve member, the wall between the central hole and the grooves is chamfered to provide knife edges. Each knife edge forms a valve seat spaced a small distance from an opposed valve surface on the adjacent valve member. In this design, an optimal valve spacing can be maintained for any flow rate; higher flow rates are accommodated simply by adding more valve members to the stack. Such systems have required high actuator forces and resulting pressures, for example, approximately 500 to 1,000 psi, to maintain the homogenization pressure in the homogenization valve.

SUMMARY OF THE INVENTION

In accordance with aspects of the present invention, the homogenization valve includes a housing and stacked valve members within the housing. The valve members have central holes therethrough defining a high pressure volume. Each valve member includes a valve seat defining, with a valve surface, gaps through which fluid is expressed radially from an inside high pressure volume to the outer low pressure volume. An actuator closes one end of the central volume and acts on the valve members to control the width of the gaps. A pressure barrier is positioned within the central volume to reduce the force from the central volume acting on the actuator. In particular, the pressure barrier may be a post fixed to the housing and having a fluid seal between the post and actuator.

By reducing the amount of actuator force required to maintain a predetermined homogenization pressure, preexisting actuators can be used for applications, such as silicone emulsions in coating fabrics, which require even higher actuator force than presently available. As a consequence of the reduced actuator force that is required, pneumatic actuators that use conventional air supply devices, for example, 85 psi, can be used in accordance with the present invention. Pneumatic actuators eliminate the need for an electric pump, a heat exchanger including cooling coils, and other accessories associated with hydraulic actuators.

In accordance with another aspect of the present invention, annular springs that align adjoining pairs of valve members are positioned within spring-grooves in the valve members. Preferably, the springs are positioned in the high pressure volume so that the springs are exposed to less turbulent flow.

In accordance with yet other aspects of the present invention, the valve members include integral spacing elements to maintain the gaps at predetermined widths wherein the actuator adjusts the width of substantially all of the gaps by compressing the spacing elements. The spacing elements can be formed from a first material such as stainless steel and the valve seats and valve surfaces can be formed from a second material such as tungsten-carbide. This configuration minimizes wear of the valve seat and surface while allowing compression of the spacing elements to maintain the valve gaps.

A flow restrictor may be provided on the outlet of the homogenization valve to create back pressure therein. The valve can further include an axially directed surface exposed to the back pressure to substantially counterbalance forces from the back pressure against the actuator.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
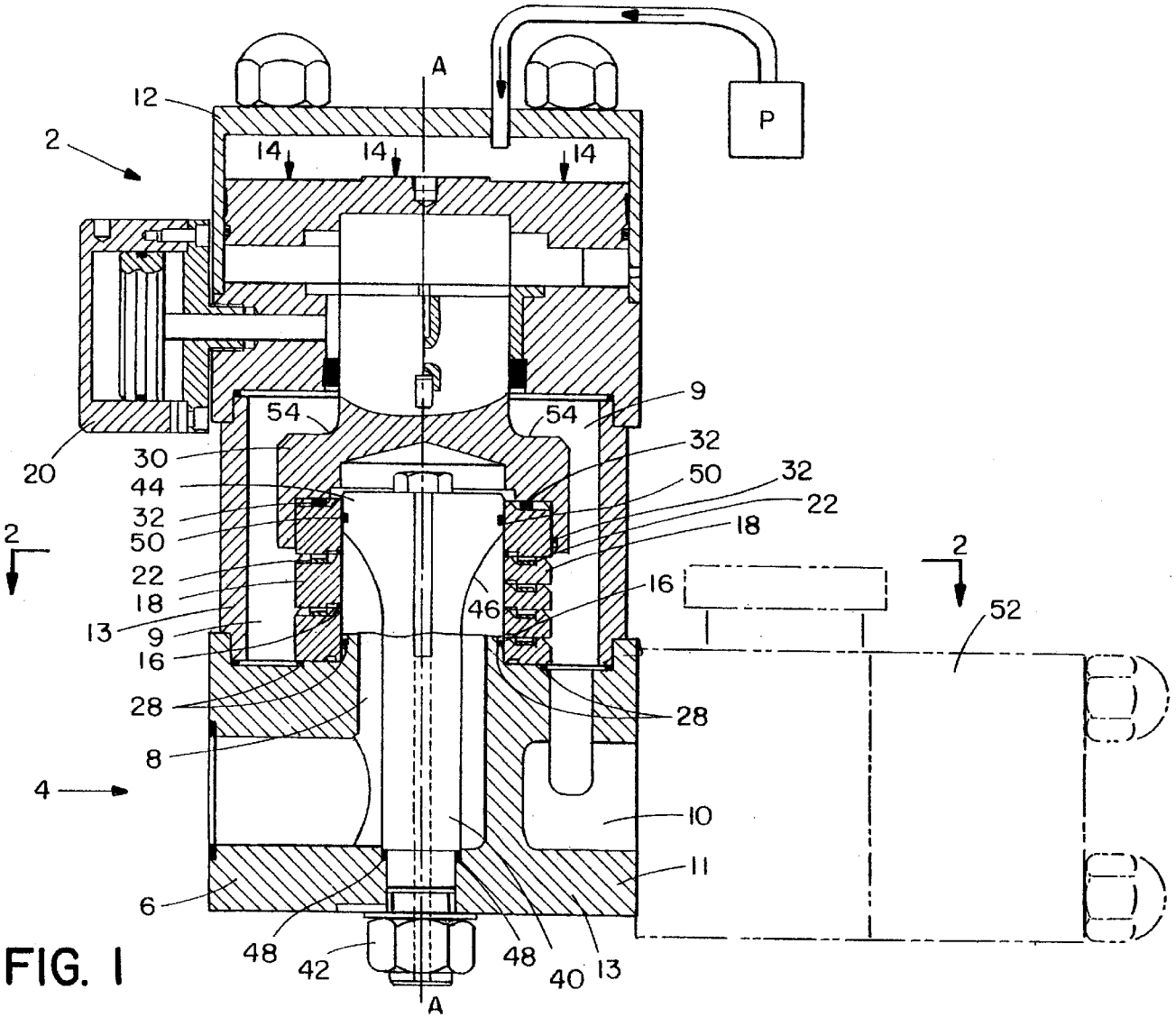
FIG. 1 is a cross sectional view of a preferred embodiment of a hydraulically balanced homogenization valve in accordance with the present invention.
Figure 2:
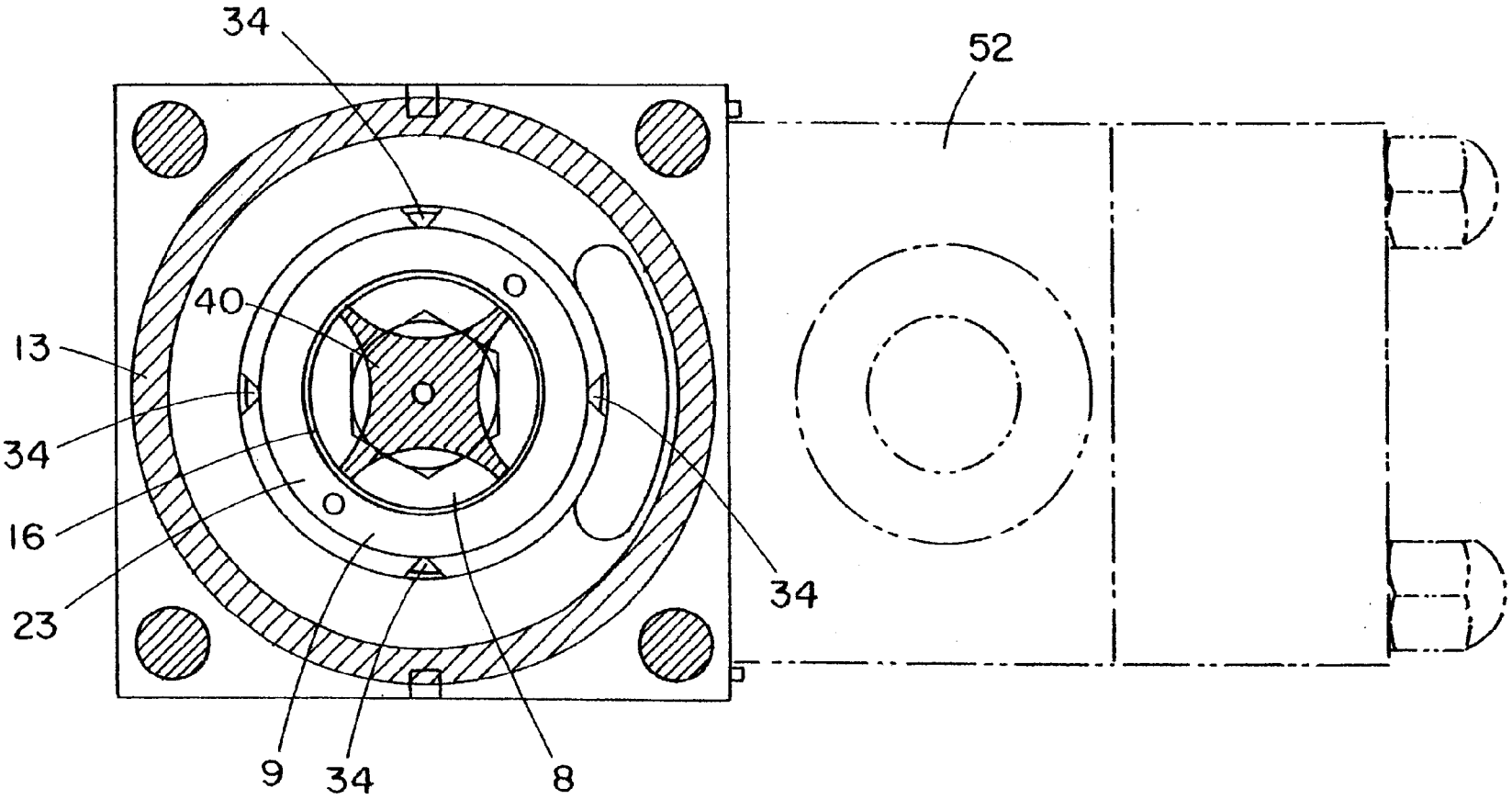
FIG. 2 is a cross sectional view taken along line 2—2 of FIG. 1.

FIG. 1 is a cross sectional view of a hydraulically balanced primary valve assembly 2 for use in a homogenizing system (complete system not shown) that has been constructed according to the principles of the present invention.

High pressure fluid driven by a pump (not shown) enters inlet port 4 of inlet flange 6 where it is directed into high pressure central chamber or volume 8. The high pressure fluid from high pressure chamber 8 is expressed through valve gaps 16 into an outer low pressure chamber or volume 9. The fluid passing into the low pressure chamber 9 enters outlet port 10 of outlet flange 11. Inlet flange 6 and outlet flange 11 form part of housing 13 which also surrounds the valve gaps 16 and forms the outer periphery of the low pressure chamber 9. It is noted that two different embodiments of the invention are shown on either side of longitudinal axis A—A, the one to the left having two valve gaps 16 and the one to the right having four gaps. The number of gaps 16 is controlled by choosing different sets of valve members placed in the assembly 2.

A pneumatic system P delivers high pressure fluid to actuator 12 thereby applying a downward force in the direction of arrows 14. Thus, the actuator 12 moves the force transfer member 30 downward to compress the valve members 18. A second actuator 20 may be provided to apply side pressure on member 30 to reduce vibration of the same.

Figure 3:
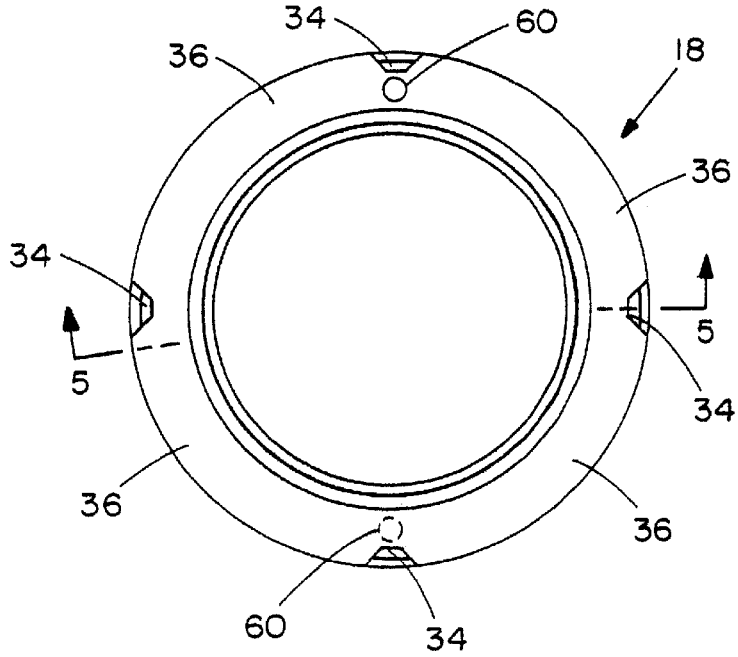
FIG. 3 illustrates a plan view of an exemplary valve member with spacer pads in accordance with the present invention.
Figure 4:
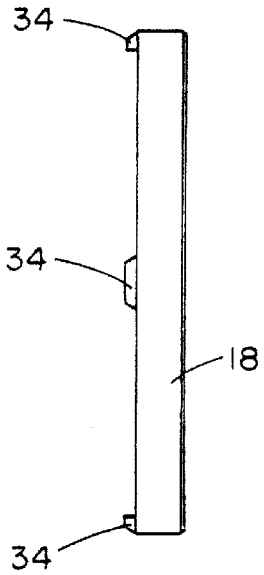
FIG. 4 is a side view of the valve member shown in FIG. 3.

As illustrated, gaps 16 and valve springs 22 are provided between each valve member pair. The gaps 16 provided between each valve member pair form a restricted passageway through which the emulsion or dispersion is expressed to the low pressure chamber 9. The gaps 16 can be constructed according to that illustrated in FIG. 3 of the '769 patent. Preferably, the gaps 16 are constructed according to those disclosed in commonly assigned U.S. Pat. No. 5,749,650, filed Mar. 13, 1997, and U.S. Pat. No. 5,899,564 filed May 11, 1998, the contents of both patents being incorporated herein in their entirety by this reference.

More specifically, the height of the gap 16 is preferably between 0.0013 and 0.0018 inches, usually about 0.0015 inches, but in any event less than 0.003 inches. This dimension is defined as the vertical distance between the valve seat or land and the opposed, largely flat, valve surface. Experimentation has shown that the gap should not be simply increased beyond 0.003 inches to obtain higher flow rates since such increases will lead to lower homogenization efficiencies.

Figure 5:
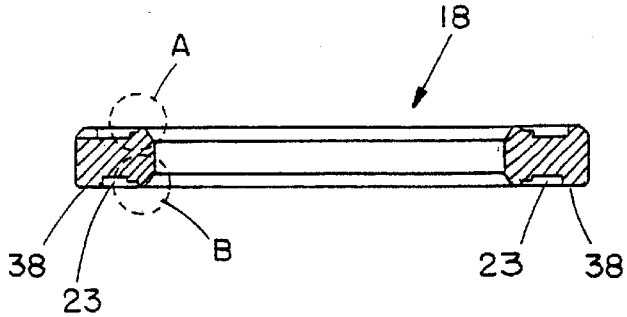
FIG. 5 is a cross sectional view taken along line 5—5 of FIG. 3.
Figure 6:
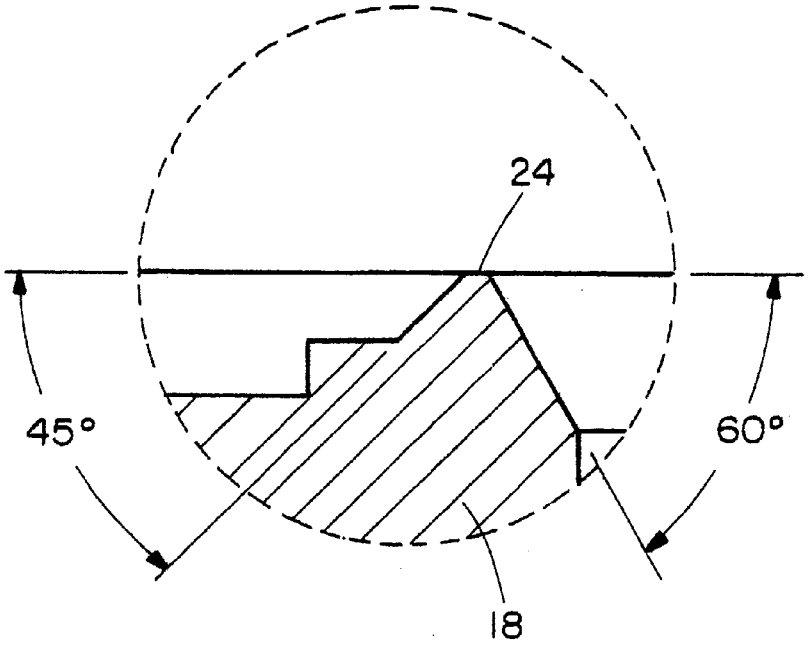
FIG. 6 is an enlarged view of the encircled area referenced as "A" of FIG. 5.
Figure 7:
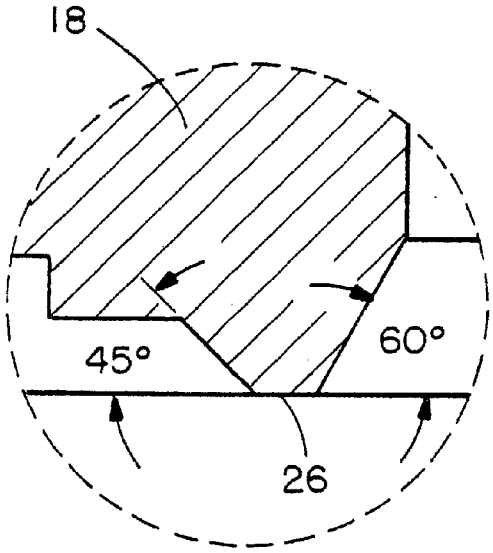
FIG. 7 is an enlarged view of the encircled area referenced as "B" of FIG. 5.
Figure 8:
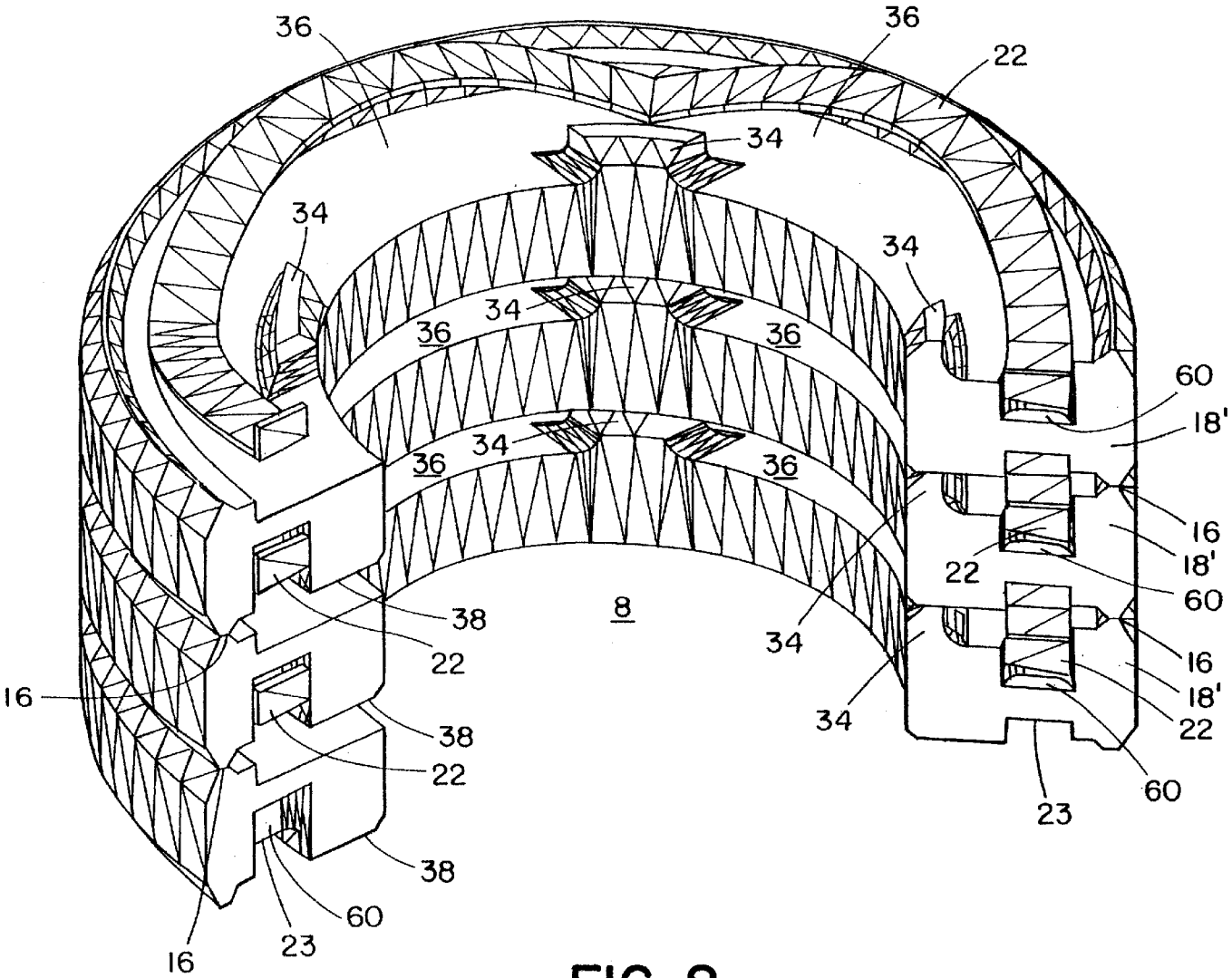
FIG. 8 is a cross sectional isometric view of an alternative valve member.

In the preferred embodiment, the valve seat is a knife-edge configuration. With reference to FIGS. 5–7, on the upstream, high pressure side of the gap, the valve seat or land 24 is chamfered at 60° angle sloping toward the valve surface 26. In the gap, the valve seat 24 is flat across a distance of ideally approximately 0.015 to 0.020 inches, but less than 0.06 inches. On the downstream, low pressure side of the gap 16, the valve seat 24 slopes away from the valve surface 26 at an angle from 5 to 90° or greater, approximately 45° in the illustrated embodiment. As particularly illustrated in FIG. 7, the valve surface 26 is similarly constructed. The downstream terminations of valve surfaces overlap valve seats or lands by no more than 0.025 inches. Preferably, the downstream terminations of the valve surfaces 26 overlap the valve seats 24 by at least a height of the valve gaps 16. It has also been found that no overlap between the valve seats 24 and valve surfaces 26 can be effective as well.

Returning to FIG. 1, the stack of valve members 18 is sealed against the inlet flange 6 and outlet flange 11 at its lower end by O-rings 28. The top-most valve member 18 engages force transfer member 30 which is hydraulically or pneumatically urged by actuator 12. By varying the pressure of a hydraulic fluid or pneumatically in actuator 12, the pressure applied to member 30 can be dynamically adjusted to control the size of the valve gap 16. O-rings 32 provide a fluid seal between the top valve member 18 and member 30.

It is known that the valve gaps increase with use of the valve as the fluid wears down the valve seat and valve surfaces. This results in a decreased pressure differential between the inner high pressure chamber 8 and the low pressure chamber 9. Consequently, the fluid may not be properly homogenized. Prior art systems have employed the actuator to apply an increased downward force to close the desired number of valve gaps (e.g., usually two or three valve gaps to maintain a constant flow area). For example, as disclosed in the '769 patent, the downward force flexes the top valve members to close the desired number of valve gaps to adjust the pressure differential.

The inventive valve members 18 include spacing elements or pads which allow the valve members to be compressed by the actuator 12 such that substantially all the valve gaps 16 are adjusted to compensate for wear. This has the advantage of maintaining a predetermined (and often optimized) separational distance between the valve seat and valve surface as wear occurs.

FIGS. 3–5 and FIG. 8 illustrate exemplary spacer pads 34 that form part of valve member 18. Area 36 is machined off leaving the spacer pads 34. Valve members 18 are stacked on one another with spacer pads 34 of one valve member contacting the underside 38 of a contiguous valve member to form the valve gaps 16 between the valve seat 24 and opposing valve surface 26. Alternatively, spacers pads 34 can be a separate element coupled to or positioned adjacent the valve members 18. The spacer pads 34 are small enough such that they can be compressed by the actuator 12. In a preferred embodiment of the present invention, each spacer pad 34 has a surface area of approximately 11 $mm^2$ that touches the underside 38 of a contiguous valve member 18 when assembled. This allows each spacer pad 34 to be compressed up to about 0.002 inches (0.0508 mm).

The valve members 18 are aligned with respect to each other and maintained in the stack formation by serpentine or wave valve springs 22 that are confined within cooperating spring-grooves 23 formed in each valve member. The valve springs 22 also spread the valve members 18 apart to increase the valve gaps 16 when the actuating pressure is reduced in a valve cleaning operation. Furthermore, the valve spring 22 ends can be bent, for example, 90 degrees, and inserted into machined notches or pockets 60 (see FIGS. 3 and 8) in adjacent valve members such that the stack of valve members maintains preferable angular alignment. Such a configuration prevents rotation of the valve members relative to one another. That is to say, the spacer pads 34 are aligned in vertical rows when preferably aligned.

Although the valve gaps 16 of FIG. 1 are shown to be adjacent the high pressure chamber 8, the valve members 18 can be configured such that the valve gaps are adjacent the low pressure chamber 9. This configuration is shown by alternative valve member 18' of FIG. 8. This allows the turbulent expressed fluid into the open chamber 9 and not over the springs, an arrangement which has been found to minimize chattering of the valve members 18. Chattering of the valve members 18 is undesirable as such can damage the valve members, emit noise, and produce other deleterious effects in the operation of the valve 2.

The high pressure fluid in chamber 8 causes an upward force on member 30 equal to the product of pressure and the area of member 30 exposed to the pressure. In prior systems, that area was the entire area within the circular valve gaps. In accordance with an aspect of the present invention, the area of member 30 which is exposed to the high pressure of chamber 8 is substantially reduced by a pressure barrier or post 40 within the central high pressure chamber which is secured at its lower end to the housing 13 by a nut 42.

At the upper end of pressure barrier 40, a wider or flared portion 44 provides a surface 46 to absorb the upward force of the high pressure fluid in chamber 8. The pressure barrier 40 is sealed against the housing 13 at its lower end by O-ring 48. The pressure barrier is sealed against the top-most valve member 18 at its upper end by O-ring 50. Essentially, the pressure barrier 40 acts as a plug to absorb the majority of the upward force in chamber 8, transmitting the force to the housing and thus reducing the net force acting on the actuator. Hence, a valve 2 is provided wherein a lower actuator force is required due to the portion 46 of pressure barrier 40 reducing the net surface area on which the liquid in chamber 8 may push upward against the actuator 12. Thus, the same actuator can accommodate higher homogenization pressures used in applications such as silicone emulsions in coating fabrics.

The valve may further be provided with a single stage valve 52 at the outlet flange that provides back pressure in chamber 9. Theories suggest that such back pressure suppresses cavitation and increases turbulence in chamber 9, thereby increasing the efficiency of the valve 2. The preferred back pressure is between 5% and 20% of the pressure at the inlet port 4. A back pressure of about 10% has been found particularly suitable. Other suitable flow restrictors can be employed in accordance with the present invention.

If valve 52 is employed, significant back pressure may result in chamber 9 which causes an upward force on the actuator 12. To reduce this upward force, an axially directed surface 54 is provided on member 30 on which the fluid in chamber 9 pushes downward to counteract the upward force. Thus, a counterbalancing mechanism is provided to reduce the force of back pressure on the actuator 12. The surface 54 extends to an inner radius which approximates or equals the radius of the valve gap. Appropriate counterbalancing is obtained regardless of the level of backpressure without any need for adjusting the actuator force.

Figure 9:
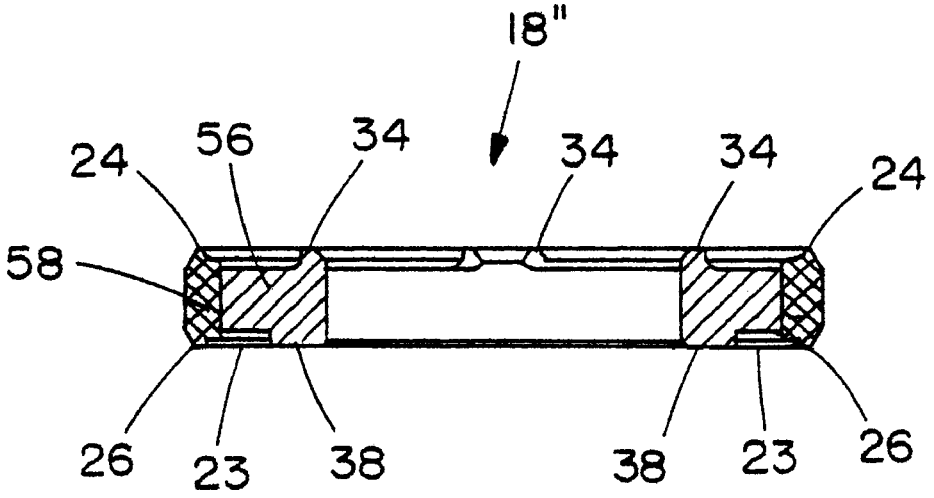
FIG. 9 is a cross sectional view of yet another alternative valve member.

FIG. 9 illustrates yet another alternative embodiment of the valve member, designated by reference numeral 18". This valve member 18" illustrates the spacer pads 34 adjacent the high pressure volume 8 and the valve seat 24 and valve surface 26 adjacent the low pressure volume 9. The valve member 18" is formed from at least two materials: a hard, durable material forming the valve seat and valve surface to minimize wear thereof and a relatively soft, compressible material forming the spacer pads to allow compression without cracking thereof. Preferably, an inner ring 56 of a relatively soft material, such as stainless steel, is inserted into an outer ring 58 of a harder, more durable material, such as tungsten-carbide. In a preferred embodiment, the hard material has a Rockwell A-scale hardness number of greater than 90 and the compressible material has a Rockwell A-scale hardness number of not greater than 80. The rings 56, 58 are maintained in position by an interference fit or other suitable methods, such as welding.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A homogenizing valve comprising:

at least two valve members having a valve seat and a valve surface defining a gap therebetween, the valve members having an inside surface defining a high pressure volume produced by a pump;

an actuator that applies a force to the valve members for controlling the width of the gap;

a housing member enclosing the valve members; and a post fixed to the housing member and positioned within the high pressure volume and sealed to prevent liquid flow around an end of the post for reducing force acting on the actuator device caused by the high pressure volume.

2. The valve of claim 1, further comprising a plurality of pairs of valve members having spring grooves and annular springs that align adjoining pairs of valve members, the springs positioned within the spring-grooves in the valve members.

3. The valve of claim 2, wherein the springs are positioned in the high pressure volume.

4. The valve of claim 3, wherein each spring has a first end and a second end and each valve member has a notch therein, each end being bent at an angle and positioned in notches of adjacent valve members to maintain angular alignment of the valve members.

5. The valve of claim 1, further comprising:

a plurality of valve members to form a plurality of valve gaps; and plurality of circumferentially spaced, deformable spacing elements between the valve surfaces and valve seats that deform to control the width of the valve gaps.

6. The valve of claim 5, wherein the spacing elements are formed from a first material and the valve surfaces and valve seats are formed from a second material.

7. The valve of claim 6, wherein the first material is stainless steel and the second material is tungsten-carbide.

8. The valve of claim 5, wherein the spacing elements are integral to the valve members.

9. The valve of claim 5, wherein the actuator adjusts the width of substantially all of the gaps by deforming the spacing elements.

10. The valve of claim 1, wherein the homogenizing valve includes a fluid outlet and further includes a flow restrictor that restricts the outlet of a fluid from the valve to create back pressure in the valve.

11. The valve of claim 10, further comprising a force transfer member disposed between the valve members and the actuator, the force transfer member having a surface exposed to the back pressure to substantially counterbalance forces from the back pressure against the actuator.

12. The valve of claim 1, wherein the actuator is a hydraulic actuator.

13. The valve of claim 1, wherein the actuator is a pneumatic actuator.

14. A homogenizing valve comprising:

a housing;

at least two valve members which define a gap through which fluid is expressed from a central volume within the valve members to an outer volume within the housing;

an actuator which applies a force to the valve members to control the width of the gap; and a pressure barrier within the central volume secured to the housing, there being a fluid seal between the pressure barrier and the actuator to limit fluid pressure applied to the actuator from the central volume.

15. The valve of claim 14, wherein the homogenizing valve includes a plurality of valve members having spring-grooves and firther comprising annular springs that align adjoining pairs of valve members, the springs positioned within the spring-grooves in the valve members.

16. The valve of claim 15, wherein the springs are positioned in the high pressure volume.

17. The valve of claim 15, wherein each spring has a first end and a second end and each valve member has a notch therein, each end being bent at an angle and positioned in notches of adjacent valve members to maintain angular alignment of the valve members.

18. The valve of claim 14, further comprising:

a fluid outlet in the housing for allowing the fluid to exit the housing;

a flow restrictor that restricts the outlet of the fluid from the outer volume to create back pressure in the housing; and a counterbalancing mechanism that substantially counterbalances forces from the back pressure against the actuator.

19. The valve of claim 14, further comprising:

a plurality of valve members having valve surfaces and valve seats to form a plurality of valve gaps; and a plurality of circumferentially spaced, deformable spacing elements between the valve surfaces and valve seats to deform to control the width of the valve gaps.

20. The valve of claim 19, wherein the spacing elements are formed from a first material and the valve surfaces and valve seats are formed from a second material.

21. The valve of claim 20, wherein the first material is stainless steel and the second material is tungsten-carbide.

22. The valve of claim 19, wherein the spacing elements are integral to the valve members.

23. The valve of claim 19, wherein the actuator adjusts the width of substantially all of the gaps by deforming the spacing elements.

24. A homogenizer valve comprising a housing and a stack of annularly-shaped valve members within the housing having central holes defining a high pressure volume, the valve members homogenizing a fluid as it passes from the high pressure volume radially outward through intervening annular valve gaps defined by opposed valve surfaces and valve seats, the valve further including an actuator that controls the width of the gaps and a pressure barrier secured to the housing and positioned within the high pressure volume, there being a fluid seal between the pressure barrier and the actuator to limit fluid pressure applied to the actuator from the high pressure volume.

25. The valve of claim 24, further comprising:

a fluid outlet in the housing for allowing the fluid to exit the housing;

a flow restrictor that restricts the outlet of a fluid from the valve to create back pressure in the same; and a counterbalancing mechanism that substantially counterbalances forces from the back pressure against the actuator.

26. The valve of claim 24, further comprising annular springs that align adjoining pairs of valve members, the springs positioned within spring-grooves in the valve members in the high pressure volume.

27. The valve of claim 26, wherein each spring has a first end and a second end, each end being bent at an angle and positioned in notches of adjacent valve members to maintain angular alignment of the valve members.

28. The valve of claim 24, further comprising a plurality of circumferentially spaced, deformable spacing elements between the valve surfaces and valve seats that deform to control the width of the valve gaps.

29. The valve of claim 28, wherein the spacing elements are integral to the valve members.

30. The valve of claim 28, wherein the spacing elements are formed from a first material and the valve surfaces and valve seats are formed from a second material.

31. The valve of claim 30, wherein the first material is stainless steel and the second material is tungsten-carbide.

32. A method of homogenizing a fluid, comprising:

expressing a fluid through a gap from an inside high pressure volume to a low pressure volume outside a plurality of valve members;

providing a housing for enclosing the valve members;

controlling the width of the gap with an actuator, and providing a pressure barrier within the inside high pressure volume which is secured to the housing and sealed to prevent liquid flow around an end of the pressure barrier, the pressure barrier substantially absorbing a force from the inside high pressure volume to prevent application of the pressure against the actuator.

33. The method of claim 32, further comprising:

restricting the outlet flow from the low pressure volume to create a back pressure against the actuator; and counterbalancing substantially all of the forces from the back pressure against the actuator.

34. The method of claim 32, further comprising:

expressing fluid through a plurality of valve gaps from the inside high pressure volume to the low pressure volume; and deforming spacing elements on the valve members with the actuator to control the width of substantially all of the gaps.

35. The method of claim 32, further comprising the step of aligning adjoining pairs of valve members with annular springs, the springs being positioned within spring-grooves in the valve members in the high pressure volume.

36. A homogenizing valve comprising:

a plurality of pairs of valve members having spring grooves and annular springs that align adjoining pairs of valve members, the springs positioned within the spring-grooves in the valve members, at least two valve members having a valve seat and a valve surface defining a gap therebetween, the valve members having an inside surface defining a high pressure volume produced by a pump;

an actuator that applies a force to the valve members for controlling the width of the gap;

a housing member enclosing the valve members; and a post fixed to the housing member and positioned within the high pressure volume for reducing force acting on the actuator device caused by the high pressure volume.

37. The valve of claim 36, wherein the springs are positioned in the high pressure volume.

38. The valve of claim 37, wherein each spring has a first end and a second end and each valve member has a notch therein, each end being bent at an angle and positioned in notches of adjacent valve members to maintain angular alignment of the valve members.

39. A homogenizing valve comprising:

a plurality of valve members forming a plurality of gaps between a valve seat and a valve surface of the valve members, the valve members having an inside surface defining a high pressure volume produced by a pump;

an actuator that applies a force to the valve members for controlling the width of the gaps;

a plurality of circumferentially spaced, deformable spacing elements between the valve surfaces and valve seats that deform to control the width of the valve gaps;

a housing member enclosing the valve members; and a post fixed to the housing member and positioned within the high pressure volume for reducing force acting on the actuator device caused by the high pressure volume.

40. The valve of claim 39, wherein the spacing elements are formed from a first material and the valve surfaces and valve seats are formed from a second material.

41. The valve of claim 40, wherein the first material is stainless steel and the second material is tungsten-carbide.

42. The valve of claim 39, wherein the spacing elements are integral to the valve members.

43. The valve of claim 39, wherein the actuator adjusts the width of substantially all of the gaps by deforming the spacing elements.

44. A homogenizing valve comprising:

a housing;

a plurality of pairs of valve members having spring grooves and annular springs that align adjoining pairs of valve members, the springs positioned within the spring-grooves in the valve members, at least two valve members having a valve seat and a valve surface defining a gap therebetween, at least two valve members which define a gap through which fluid is expressed from a central volume within the valve members to an outer volume within the housing;

an actuator which applies a force to the valve members to control the width of the gap; and a pressure barrier within the central volume secured to the housing, there being a fluid seal between the pressure barrier and the actuator to limit fluid pressure applied to the actuator from the central volume.

45. The valve of claim 44, wherein the springs are positioned in the high pressure volume.

46. The valve of claim 44, wherein each spring has a first end and a second end and each valve member has a notch therein, each end being bent at an angle and positioned in notches of adjacent valve members to maintain angular alignment of the valve members.

47. A homogenizing valve comprising:

a housing;

a plurality of valve members having valve surfaces and valve seats to form a plurality of valve gaps through which fluid is expressed from a central volume within the valve members to an outer volume within the housing;

an actuator which applies a force to the valve members to control the width of the gaps;

a plurality of circumferentially spaced, deformable spacing elements between the valve surfaces and valve seats to deform to control the width of the valve gaps; and a pressure barrier within the central volume secured to the housing, there being a fluid seal between the pressure barrier and the actuator to limit fluid pressure applied to the actuator from the central volume.

48. The valve of claim 47, wherein the spacing elements are formed from a first material and the valve surfaces and valve seats are formed from a second material.

49. The valve of claim 48, wherein the first material is stainless steel and the second material is tungsten-carbide.

50. The valve of claim 47, wherein the spacing elements are integral to the valve members.

51. The valve of claim 47, wherein the actuator adjusts the width of substantially all of the gaps by deforming the spacing elements.

52. A homogenizer valve comprising a housing and a stack of annularly-shaped valve members within the housing having central holes defining a high pressure volume, the valve members homogenizing a fluid as it passes from the high pressure volume radially outward through intervening annular valve gaps defined by opposed valve surfaces and valve seats, the valve further including an actuator that controls the width of the gaps and a pressure barrier secured to the housing and positioned within the high pressure volume, the valve also including annular springs that align adjoining pairs of valve members, the springs positioned within spring-grooves in the valve members in the high pressure volume, there being a fluid seal between the pressure barrier and the actuator to limit fluid pressure applied to the actuator from the high pressure volume.

53. The valve of claim 52, wherein each spring has a first end and a second end, each end being bent at an angle and positioned in notches of adjacent valve members to maintain angular alignment of the valve members.

54. A homogenizer valve comprising a housing and a stack of annularly-shaped valve members within the housing having central holes defining a high pressure volume, the valve members homogenizing a fluid as it passes from the high pressure volume radially outward through intervening annular valve gaps defined by opposed valve surfaces and valve seats, the valve further including an actuator that controls the width of the gaps, the valve including a plurality of circumferentially spaced, deformable spacing elements between the valve surfaces and valve seats that deform to control the width of the valve gaps, the valve further including a pressure barrier secured to the housing and positioned within the high pressure volume, there being a fluid seal between the pressure barrier and the actuator to limit fluid pressure applied to the actuator from the high pressure volume.

55. The valve of claim 54, wherein the spacing elements are integral to the valve members.

56. The valve of claim 54, wherein the spacing elements are formed from a first material and the valve surfaces and valve seats are formed from a second material.

57. The valve of claim 56, wherein the first material is stainless steel and the second material is tungsten-carbide.

58. A method of homogenizing a fluid, comprising:

expressing a fluid through a plurality of gaps from an inside high pressure volume to a low pressure volume outside a plurality of valve members;

providing a housing for enclosing the valve members;

controlling the width of substantially all of the gaps with an actuator by deforming spacing elements on the valve members; and providing a pressure barrier within the inside high pressure volume which is secured to the housing and substantially absorbing a force from the inside high pressure volume to prevent application of the pressure against the actuator.

59. A method of homogenizing a fluid, comprising:

expressing a fluid through a gap from an inside high pressure volume to a low pressure volume outside a plurality of valve members;

aligning adjoining pairs of valve members with annular springs, the springs being positioned within spring-grooves in the valve members in the high pressure volume;

providing a housing for enclosing the valve members;

controlling the width of the gap with an actuator; and providing a pressure barrier within the inside high pressure volume which is secured to the housing and substantially absorbing a force from the inside high pressure volume to prevent application of the pressure against the actuator.

* * * * *